US007219959B2

(12) United States Patent
Ransil et al.

(10) Patent No.: US 7,219,959 B2
(45) Date of Patent: May 22, 2007

(54) CHILD SWING WITH RECLINE MECHANISM

(75) Inventors: Matthew J. Ransil, Richland, PA (US); Jeff G. Greger, Lititz, PA (US)

(73) Assignee: Graco Children's Products Inc., Exton, PA (US)

( * ) Notice: Subject to any disclaimer, the term of this patent is extended or adjusted under 35 U.S.C. 154(b) by 51 days.

(21) Appl. No.: 11/079,515

(22) Filed: Mar. 15, 2005

(65) Prior Publication Data

US 2006/0214486 A1 Sep. 28, 2006

(51) Int. Cl.

| | |
|---|---|
| ***A63G 9/00*** | (2006.01) |
| ***A63G 9/02*** | (2006.01) |
| ***A47D 13/00*** | (2006.01) |
| ***A47D 13/10*** | (2006.01) |
| ***B60N 2/22*** | (2006.01) |

(52) U.S. Cl. ..... 297/277; 297/273; 297/354.12; 297/374; 297/376; 297/377

(58) Field of Classification Search ..... 297/273, 297/274, 277, 278, 354.12, 374, 376, 377
See application file for complete search history.

(56) References Cited

U.S. PATENT DOCUMENTS 4,231,612 A * 11/1980 Meeker ..... 297/256.13
4,324,432 A * 4/1982 Eldon et al. ..... 297/377
4,435,012 A * 3/1984 Kassai ..... 297/354.12
4,697,845 A * 10/1987 Kamman ..... 297/377 X
4,805,928 A * 2/1989 Nakao et al. ..... 297/377 X
4,938,603 A * 7/1990 Turner et al. ..... 297/16.1
5,018,754 A * 5/1991 Cheng ..... 297/354.12 X
5,069,474 A * 12/1991 Tai ..... 297/354.12 X (Continued)

OTHER PUBLICATIONS

U.S. Appl. No. 10/999,148, filed Nov. 30, 2004, Gangadharan.

(Continued)

*Primary Examiner*—Rodney B. White
(74) *Attorney, Agent, or Firm*—Lempia Forman LLC

(57) ABSTRACT

A swing seat configured to be supported by a swing frame includes a seat bottom frame, a seat back frame movably coupled to the seat bottom frame, and a recline mechanism to recline the seat back frame relative to the seat bottom frame. The recline mechanism includes first and second mounts on opposite sides of the seat back frame to movably mount the seat back frame to the seat bottom frame, at least one recline lock associated with at least one of the first and second mounts and configured to lock the seat back frame in at least two recline positions relative to the seat bottom frame, and a recline actuator having a grip intermediate the first and second mounts and movable between an un-actuated position and an actuated position. The at least one recline lock is movable between a locked position to set the recline position of the seat back frame relative to the seat bottom frame and an unlocked position to allow adjustment of the recline position of the seat back frame relative to the seat bottom frame. The recline actuator is coupled to the at least one recline lock such that movement of the recline actuator from the un-actuated position to the actuated position moves the at least one recline lock from the locked position to the unlocked position.

44 Claims, 10 Drawing Sheets

U.S. PATENT DOCUMENTS 5,195,770 A * 3/1993 Ishikura ..... 297/61 X
5,240,265 A * 8/1993 Huang ..... 297/354.12 X
5,669,664 A * 9/1997 Perego ..... 297/376 X
5,795,091 A 8/1998 Kakuda et al.
5,803,817 A 9/1998 Stern
5,820,207 A * 10/1998 Wang ..... 297/27
5,975,631 A * 11/1999 Fair et al. ..... 297/354.12 X
6,068,284 A 5/2000 Kakuda ..... 297/273
6,089,653 A * 7/2000 Hotaling et al. .... 297/354.12 X
6,161,898 A * 12/2000 Brevi ..... 297/328
6,334,652 B1 * 1/2002 Chen et al. ..... 297/256.13 X
6,561,915 B2 * 5/2003 Kelly et al. ..... 297/277 X
6,645,080 B1 11/2003 Greger et al.
6,666,505 B2 12/2003 Greger et al. ..... 297/354.12 X
6,877,802 B2 4/2005 Christensen et al.
6,896,624 B2 * 5/2005 Longenecker et al. .. 297/273 X
6,902,489 B2 6/2005 Greger et al. ..... 297/354.12 X
2004/0036335 A1 * 2/2004 Gentil ..... 297/354.12
2004/0198512 A1 10/2004 Ransil et al.
2005/0029852 A1 * 2/2005 Chen ..... 297/354.12

OTHER PUBLICATIONS

Graco® Owner's Manual for 6-Speed Open Top™ Infant Swing 1488, 2003, Graco Children's Products Inc., pp. 1-44.

* cited by examiner

CHILD SWING WITH RECLINE MECHANISM

FIELD OF THE INVENTION

This invention relates to a child swing. More specifically, this invention relates to a child swing that has a recline mechanism so that a child caregiver can recline the seat back of the swing with one hand.

BACKGROUND OF THE INVENTION

Various types of swings are known. Typically, the swing includes a support frame, a hanger arm or arms pivotally attached to the support frame, and a seat attached to the hanger arm or arms. The swing also can include an electrically powered drive mechanism to move the swing seat in a back-and-forth motion.

Some swings include a seat back recline mechanism. The seat back of these swings can be adjusted to different recline angles relative to the seat bottom so that a caregiver can position the seat in various recline positions, including an upright position, a fully reclined position, or an intermediate position between the upright position and the fully reclined position, depending on the age and needs of the child. Older children may prefer a more upright position, while younger children with less neck control may prefer a more reclined position.

The seat back recline mechanism of one existing swing product includes a bent wire that travels along a slot or pair of slots formed as part of the seat back. The location of the wire in the slot determines the recline position of the swing seat. The wire can be mounted to hanger arms on either side of the seat back or to another suitable structure. To adjust the wire to a different recline location in the slot, a caregiver can use one hand to move the wire and the other hand to support the seat back. These wire arrangements are not intuitive or easy to operate for all caregivers.

A different seat back recline mechanism for a swing seat includes latches positioned on opposite sides of the seat back to engage latch-receiving ribs positioned on the hanger arms of the swing. The ribs correspond to different seat back recline angles. To change the recline angle of the seat back, a caregiver can grip the latches directly and re-position the latches against ribs corresponding to the desired seat back recline angle. This seat back recline mechanism can be awkward to operate for some caregivers.

There is a need for a swing with an improved seat back recline mechanism.

SUMMARY OF THE INVENTION

An aspect of the invention relates to a swing that includes a swing frame and a seat supported by the swing frame. The seat includes a seat bottom frame, a seat back frame movably coupled to the seat bottom frame, and a recline mechanism to recline the seat back frame relative to the seat bottom frame. The recline mechanism includes first and second mounts on opposite sides of the seat to movably mount the seat back frame to the seat bottom frame, at least one recline lock associated with at least one of the first and second mounts and configured to lock the seat back frame in at least two recline positions relative to the seat bottom frame, and a recline actuator having a grip intermediate the first and second mounts and movable between an un-actuated position and an actuated position. The at least one recline lock is movable between a locked position to set the recline position of the seat back frame relative to the seat bottom frame and an unlocked position to allow adjustment of the recline position of the seat back frame relative to the seat bottom frame. The recline actuator is coupled to the at least one recline lock such that movement of the recline actuator from the un-actuated position to the actuated position moves the at least one recline lock from the locked position to the unlocked position.

Another aspect of the invention relates to a swing seat configured to be suspended from a swing frame. The swing seat includes a seat bottom frame, a seat back frame movably coupled to the seat bottom frame, and a recline mechanism to recline the seat back frame relative to the seat bottom frame. The recline mechanism includes first and second mounts on opposite sides of the seat to movably mount the seat back frame to the seat bottom frame, at least one recline lock associated with at least one of the first and second mounts and configured to lock the seat back frame in at least two recline positions relative to the seat bottom frame, and a recline actuator having a grip intermediate the first and second mounts and movable between an un-actuated position and an actuated position. The at least one recline lock is movable between a locked position to set the recline position of the seat back frame relative to the seat bottom frame and an unlocked position to allow adjustment of the recline position of the seat back frame relative to the seat bottom frame. The recline actuator is coupled to the at least one recline lock such that movement of the recline actuator from the un-actuated position to the actuated position moves the at least one recline lock from the locked position to the unlocked position.

Another aspect of the invention relates to a swing seat configured to be suspended from a swing frame. The swing seat includes a seat bottom frame, a seat back frame movably coupled to the seat bottom frame, and a recline mechanism to recline the seat back frame relative to the seat bottom frame. The recline mechanism includes first and second mounts on opposite sides of the seat to movably mount the seat back frame to the seat bottom frame, first and second recline locks associated with the first and second mounts, respectively, and configured to lock the seat back in at least two recline positions relative to the seat bottom, each of the first and second recline locks movable between a locked position to set the recline position of the seat back frame relative to the seat bottom frame and an unlocked position to allow adjustment of the recline position of the seat back frame relative to the seat bottom frame, and a recline actuator having a grip remote from the first and second recline locks, the recline actuator being coupled to the first and second recline locks such that movement of the recline actuator from the un-actuated position to the actuated position moves the first and second recline locks from the locked position to the unlocked position.

Another aspect of the invention relates to a swing seat configured to be suspended from a swing frame. The swing seat includes a seat bottom frame, a seat back frame movably coupled to the seat bottom frame, and a recline mechanism to recline the seat back frame relative to the seat bottom frame. The recline mechanism includes first and second mounts on the seat to movably mount the seat back frame to the seat bottom frame, at least one recline lock associated with at least one of the first and second mounts and configured to lock the seat back frame in at least two recline positions relative to the seat bottom frame, and a recline actuator arranged between the first and second mounts and movable between an un-actuated position and an actuated position. The at least one recline lock is movable between a locked position to set the recline position of the seat back frame relative to the seat bottom frame and an unlocked position to allow adjustment of the recline position of the seat back frame relative to the seat bottom frame. The recline actuator can be actuated from a location remote from the at least one recline lock, and movement of the recline actuator from the un-actuated position to the actuated position moves the at least one recline lock from the locked position to the unlocked position.

Another aspect of the invention relates to a swing that includes a swing frame, first and second hanger arms movably mounted to the swing frame, a seat supported by the first and second hanger arms on the swing frame, and a recline mechanism to recline the seat relative to the first and second hanger arms. The recline mechanism including first and second mounts coupling the seat to the first and second hanger arms, respectively.

Another aspect of the invention relates to a swing seat configured to be suspended from a swing frame. The swing seat includes a seat bottom frame, a seat back frame movably coupled to the seat bottom frame, and a recline mechanism to recline the seat back frame relative to the seat bottom frame. The recline mechanism includes at least one mount on the seat to movably mount the seat back frame to the seat bottom frame, at least one recline lock associated with the at least one mount, and a recline actuator coupled to the at least one recline lock. The at least one recline lock is configured to lock the seat back frame in at least two recline positions relative to the seat bottom frame, and the at least one recline lock is movable between a locked position to set the recline position of the seat back frame relative to the seat bottom frame and an unlocked position to allow adjustment of the recline position of the seat back frame relative to the seat bottom frame. The recline actuator is movable between an un-actuated position and an actuated position, such that the recline actuator can be actuated from a location remote from the at least one recline lock, and movement of the recline actuator from the un-actuated position to the actuated position moves the at least one recline lock from the locked position to the unlocked position.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
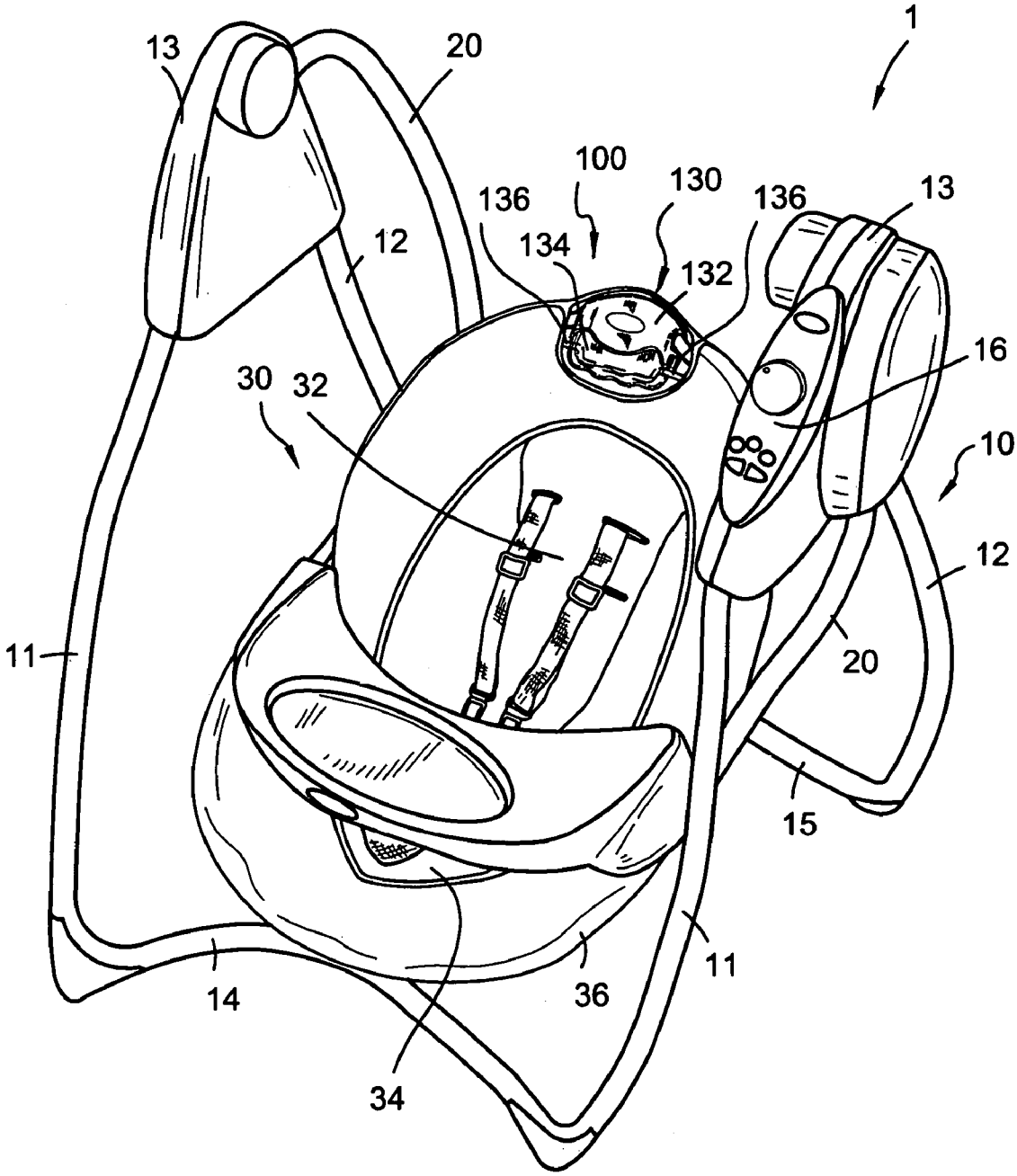
FIG. 1 is a front perspective view of a swing incorporating a recline mechanism in accordance with the invention.

FIG. 1 illustrates a swing 1 including a one-hand recline mechanism 100 according to an embodiment of the invention. The one-hand recline mechanism 100 enables a caregiver to change the recline angle of the seat back of the swing seat relative to the seat bottom of the swing seat with one hand. The caregiver can move and support the seat back of the swing seat with the same hand that is used to actuate the recline mechanism 100. The seat back can assume two or more recline positions according to the invention. Possible recline positions include an upright position, a fully reclined position, or an intermediate position between the upright position and the fully reclined position, depending on the age and needs of the child. The recline mechanism 100 also serves as a weight-bearing mechanism that bears the weight of the seat back and a child placed in the seat in each of the recline positions.

The swing 1 of FIG. 1 includes a swing frame 10, a pair of hanger arms 20 rotatably coupled to the swing frame 10, and a seat 30 coupled to the hanger arms 20. The frame 10 supports the hanger arms 20 so that the seat 30 can be suspended from the frame 10.

The frame 10 can include first and second front legs 11, first and second rear legs 12, housings 13 to which the front and rear legs 11, 12 are coupled, a front cross member 14 extending between the front legs 11, and a rear cross member 15 extending between the rear legs 12. In other embodiments, the frame can include first and second front legs only or first and second rear legs only. It will be understood that the seat 30 and associated one-hand recline mechanism 100 can be employed on swings with any frame configuration. Additionally, the frame 10 optionally can be configured to fold. For example the front and/or rear legs 11, 12 can be assembled so as to pivot within the respective housings 13, such as disclosed in U.S. Pat. No. 6,645,080, issued Nov. 11, 2003, and U.S. Publication No. 2004/0198512 A1, published Oct. 7, 2004, both of which are incorporated herein by reference in their entirety.

In electric swings, the swing, such as swing 1 of FIG. 1, can include a motor mechanism and a power supply for supplying power to the motor mechanism to drive swinging motion of the seat 30. The motor mechanism and the power supply can be disposed within one the housings 13, such as the right-side housing shown in FIG. 1. Electric swings also may include a control panel 16 to control the swinging motion and other electronic features of the swing, such as music.

The swing 1 also includes a one-hand recline mechanism 100 that enables the seat back 32 of the seat 30 to recline relative to the seat bottom 34. The seat back 32 and the seat bottom 34 of the seat include a seat back frame and a seat bottom frame covered by a fabric cover 36. In one embodiment, shown in FIG. 3, the seat back frame 42 and the seat bottom frame 44 of the seat frame 40 can be tubular frame members (either hollow or solid, either wire or plastic), and the fabric cover 36 is mounted to these tubular frame members to form a sling-type swing seat. In other embodiments, the tubular frame members can be replaced with plastic straps or other suitable frame structures. In yet other embodiments, it will be understood that the seat back frame and the seat bottom frame can comprise molded plastic frame members that approximate the size and contour of the seat back and the seat bottom, respectively. In addition, the seat back frame and seat bottom frame can be molded as a single piece with a living hinge. A cover can be mounted to these molded plastic frame members to form the seat. The one-hand recline mechanism 100 can control movement of the seat back frame between its various recline positions relative to the seat bottom frame.

Figure 2:
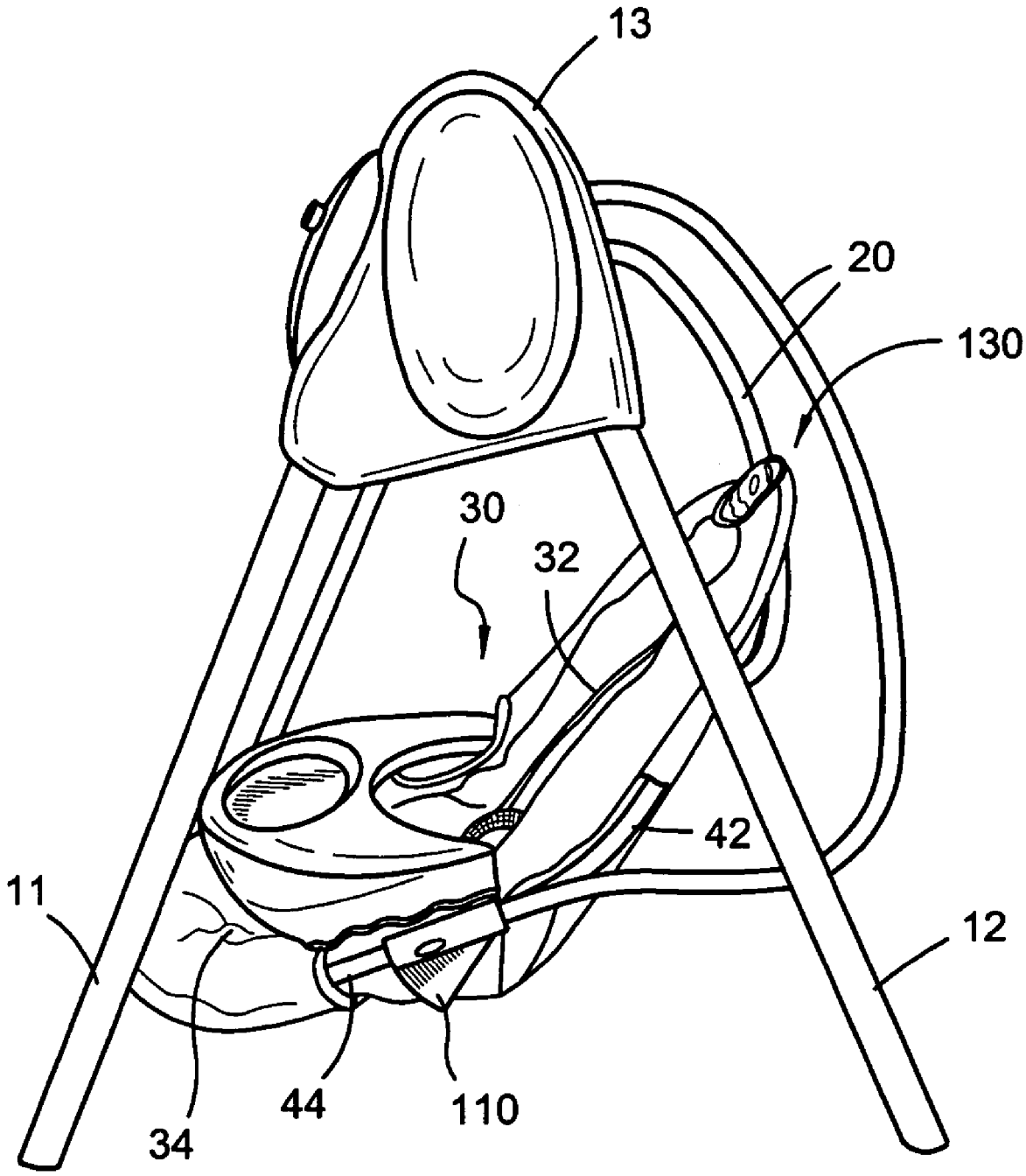
FIG. 2 is a break-away side perspective view of the swing of FIG. 1, illustrating the interconnection of a hanger arm, a seat back frame member, and a seat bottom frame member to a mount of the recline mechanism.
Figure 3:
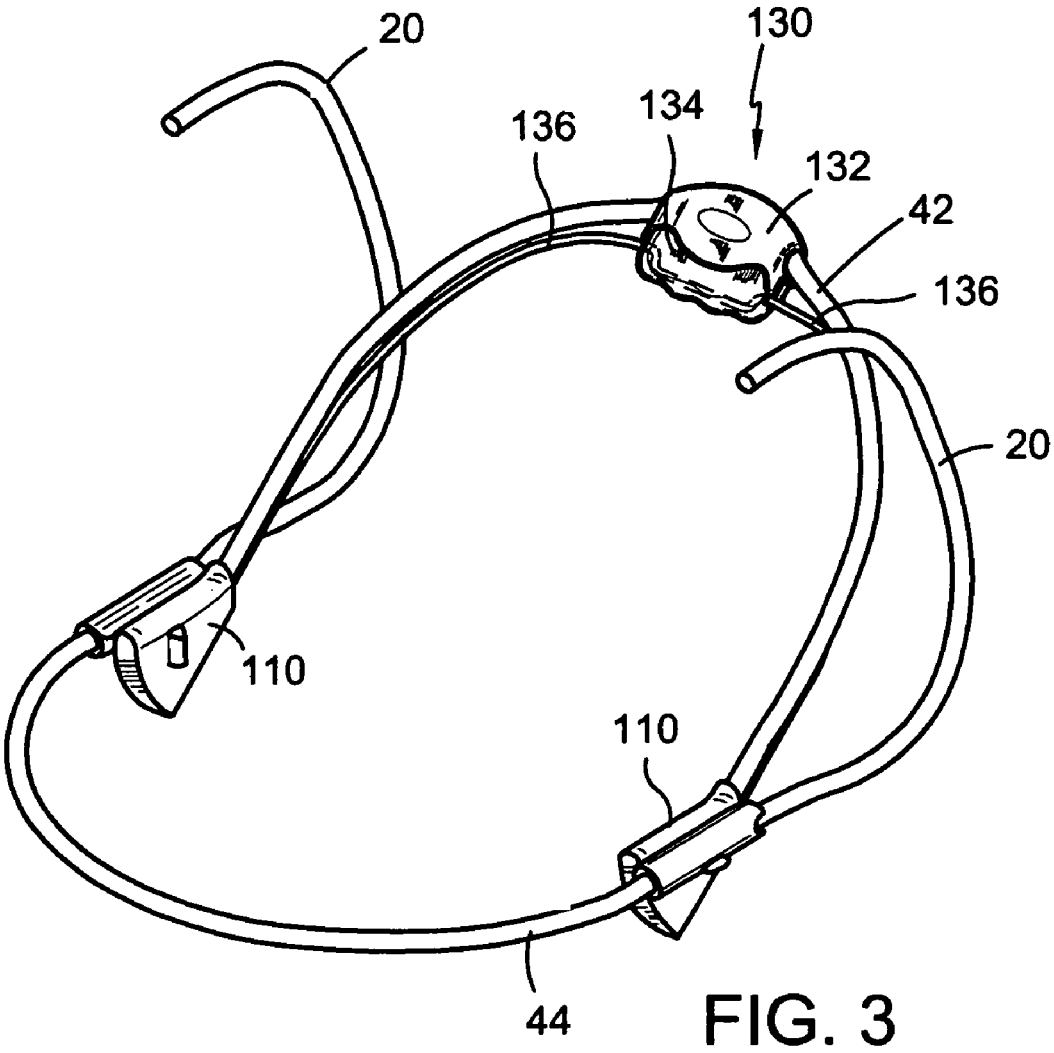
FIG. 3 is a front perspective view of the seat frame of the swing of FIG. 1, including a seat back frame and a seat bottom frame, and of the recline mechanism coupled to the seat frame.

The one-hand recline mechanism 100, as can be seen in FIGS. 2 and 3, can include first and second mounts 110 on opposite sides of the seat back frame 42 to movably mount the seat back frame 42 to the seat bottom frame 44. The seat back frame 42 is pivotally mounted to the first and second mounts 110, while the seat bottom frame 44 and the hanger arms are rigidly mounted to the first and second mounts 110, as can be seen in FIG. 3. The ends of the seat back frame 42 extend into the respective mounts 110 and are pivotally coupled to the mounts 110 by pivot pins P, as shown in FIGS. 6 and 7.

Figure 6:
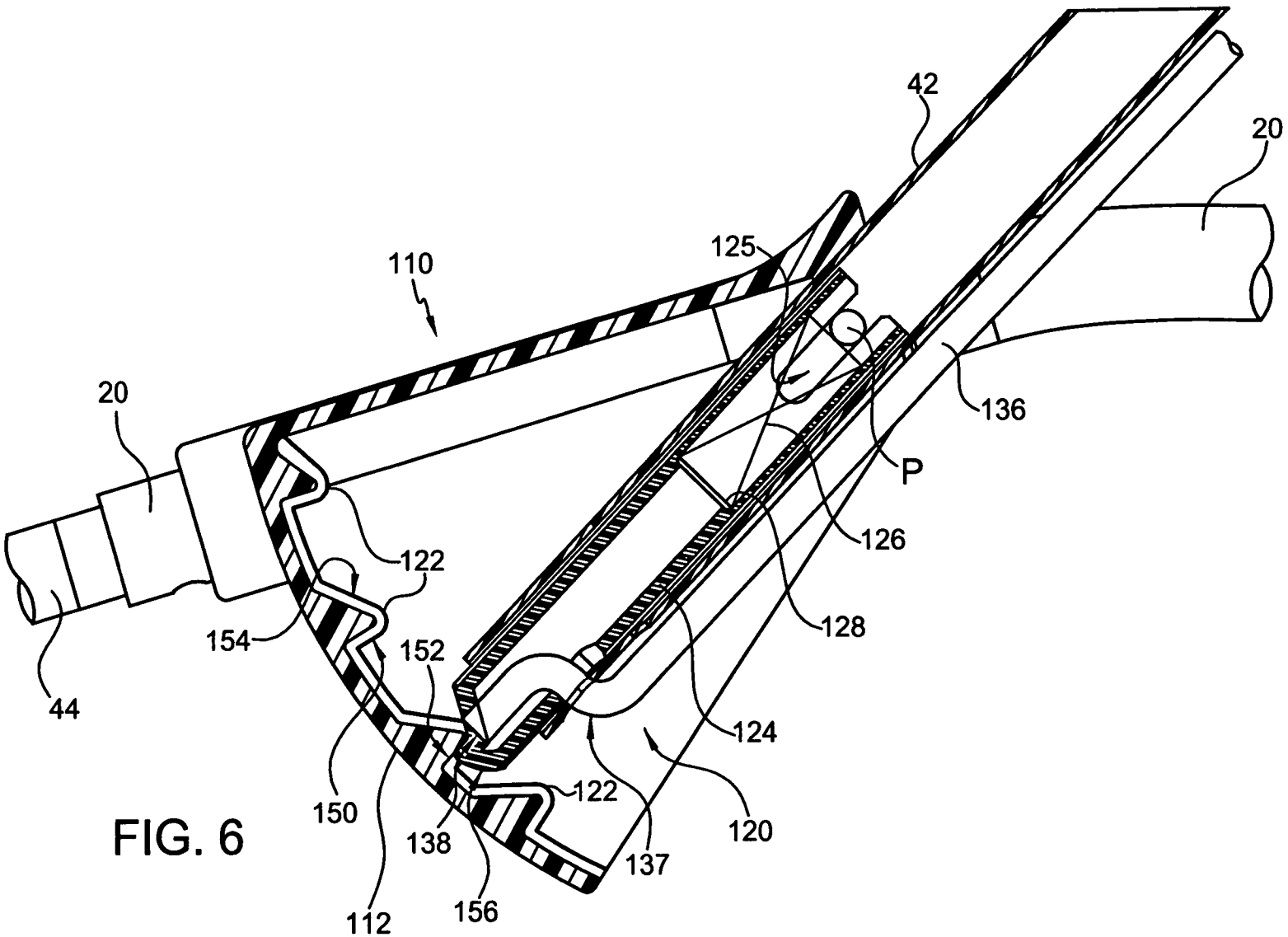
FIG. 6 is a side view, in partial cross section, of the recline lock of FIG. 5 in the locked position.
Figure 7:
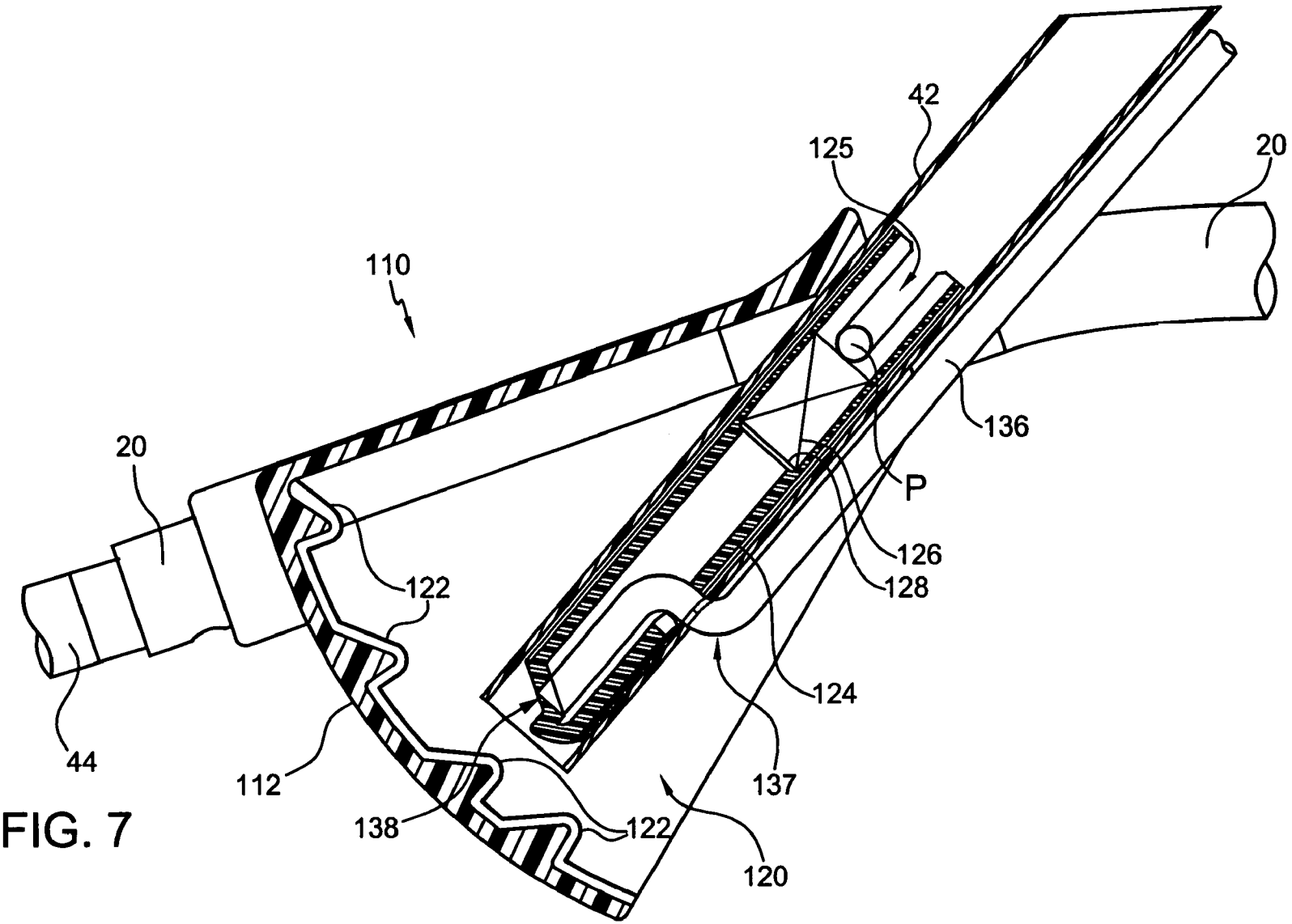
FIG. 7 is a side view, in partial cross section, of the recline lock of FIG. 5 in the unlocked position.

The one-hand recline mechanism 100 also can include a recline lock 120 associated each mount 110; the recline locks 120 are hidden by the mounts 110 in FIG. 3, but are visible in the partial cross sections of FIGS. 6–7. Each of the recline locks 120 is movable between a locked position, at which the recline position of the seat back frame 42 relative to the seat bottom frame 44 is set, and an unlocked position, at which the seat back frame 42 may be adjusted relative to the seat bottom frame 44. It will be understood that, in an alternative embodiment, the one-hand recline mechanism 100 can include only one recline lock at either the first or the second mount 110.

The one-hand recline mechanism 100 further includes a recline actuator 130 having a grip intermediate the first and second mounts 110. The recline actuator 130 is coupled to the recline locks 120, as will be described in connection with FIGS. 5–7, such that movement of the recline actuator 130 from an un-actuated position to an actuated position moves the recline locks 120 from their locked positions to their unlocked positions.

As can be seen in FIGS. 6 and 7, each recline lock 120 can include a series of detents 122 formed in an interior of the respective mount 110. The mount 110 can include an arcuate wall 112, and the detents 122 can be formed along an interior surface of the arcuate wall 112. These detents 122 correspond to the various recline positions of the seat back frame 42. FIGS. 6 and 7 illustrate a series of four detents 122 along arcuate wall 112, however, more or less detents are contemplated, depending on the number of desired recline positions. Each recline lock 120 also can include a plunger 124 connected to the recline actuator 130 to move between an unlocked position, in which the plunger 124 is spaced from the detents 122 (as shown in FIG. 7), and a locked position, in which the plunger 124 contacts a selected one of the detents 122 (as shown in FIG. 6). The plunger 124 can be slidably mounted in the seat back frame 42. The recline lock 120 further can include a spring 126 to bias the plunger 124 in the locked position. The spring 126 can extend between a spring mount 128 and the pivot pin P extending through the mount 110 about which the seat back frame 42 can pivot. The plunger 124 can include a slot 125 that receives the pivot pin P and allows the plunger 124 to retract within the seat back frame 42 from the locked position to the unlocked position.

In the embodiment of FIGS. 6 and 7, the plunger 124 is shown disposed inside the tubular seat back frame 42. In an alternative embodiment, for example one in which the seat back frame comprises a molded plastic shell, the plunger 124 can be positioned adjacent to and exteriorly of the seat back frame 42.

Figure 5:
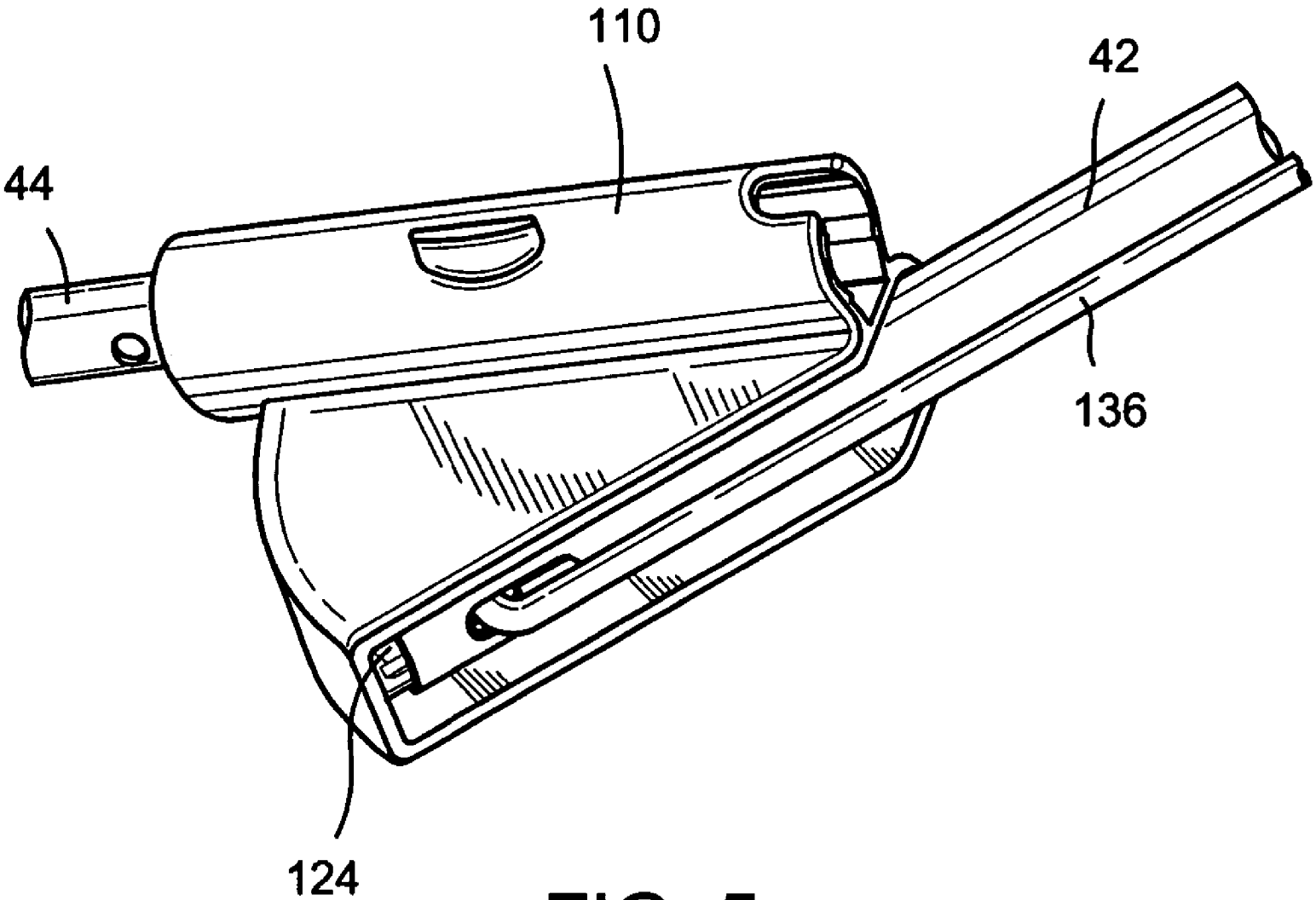
FIG. 5 is a bottom perspective view of a recline lock of the recline mechanism.

The plungers 124 are moved from their locked positions to their unlocked positions by the recline actuator 130. The recline actuator 130 can include an actuator mount 132 provided on the seat back frame 42, a grip 134 movably mounted to the actuator mount 132, and an arm 136 extending between the grip 134 and the plungers 124 of each recline lock 120. The grip 134 can include surface contouring, such as indentations, to approximate the shape of a user's fingers to facilitate gripping of the grip 134. The arm 136 can be in the form of a cable or a wire. The arm 136 can extend from the grip 134 along the contour of the tubular seat back frame 42 to each recline mount 110 for attachment to the respective plungers 124 of the recline locks 120. The arm 136 can include a bend 137 proximate each of its ends 138 so that the ends 138 can extend through aligned holes in the seat back frame 42 and respective plunger 124 to be secured to the plungers 124, as seen in FIGS. 5–7.

The actuator arm 136 is shown as a single continuous, generally U-shaped arm extending between the two reline mounts 110 and through the grip 134. Alternatively, the actuator arm can comprise first and second arms, the first arm extending from the grip 134 to the first recline mount 110 and the second arm extending from the grip 134 to the second recline mount. In addition, the actuator arm can take a different shape than the U-shape of the illustrated embodiment.

Figure 4:
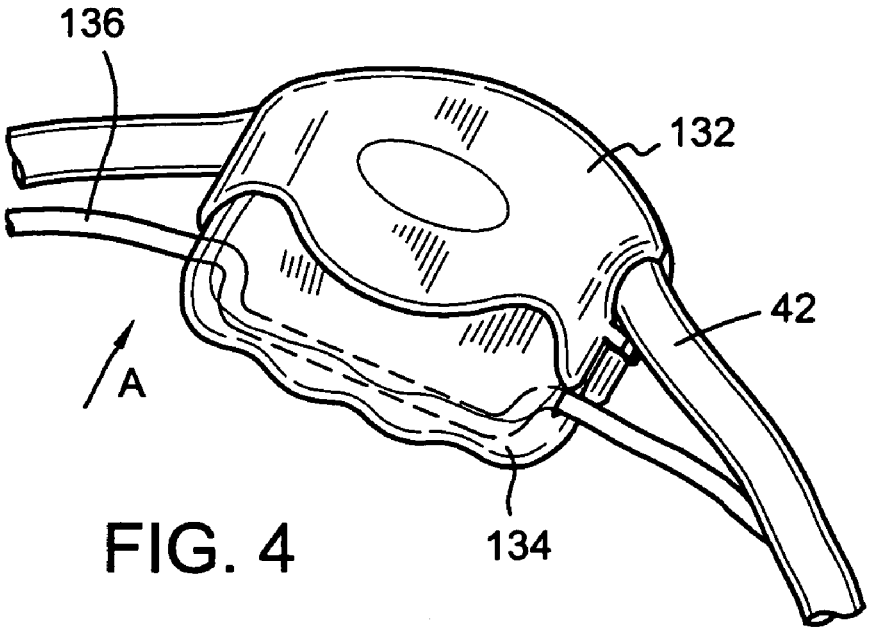
FIG. 4 is a perspective view of a recline actuator of the recline mechanism.

To move the plungers 124 from their locked positions to their unlocked positions, and hence unlock the recline locks 120, a caregiver can grasp the grip 134 and squeeze so that the grip 134 slides in a direction normal to the seat back frame 42, as indicated by arrow A in FIG. 4. The squeezing movement draws the arm 136 in the direction of arrow A, which in turn retracts the plungers 124 and moves them from their locked position (FIG. 6) to their unlocked position (FIG. 7). The caregiver then can pivot the seat back frame 42 to a desired recline position and then release the grip 134. When the caregiver releases the grip 134, the springs 126 of the recline locks 120 force the plungers 124 back to their locked positions, and movement of the plungers 124, in turn, returns the arm 136 and the grip 134 back to their un-actuated positions. Adjustment of the recline position of the seat back frame 42 thus can be accomplished with only one hand.

In addition, the recline actuator 130 is arranged relative to the seat back frame 42 so that the seat back frame 42 can be supported by the same hand that actuates the recline actuator 130. For example, in the illustrated embodiment, the grip 134 of the recline actuator 130 is located at the top of the seat back frame 42, which enables the caregiver to support easily the weight of the seat back frame 42, and any child sitting in the seat, with the same hand that adjusts the recline position of the seat back frame 42. Locating the grip 134 at the top of the seat back frame 42 also makes the grip 134 visibly obvious and easy to access. It is contemplated that the grip 134 can be located along the perimeter of the seat back frame 42 and still allow a caregiver to both recline the seat back and support the weight of the seat back, and any child sitting in the seat, with one hand. In a case where the seat back frame is a hard-shelled plastic frame that approximates the shape of the seat back, the grip 134 can be located elsewhere on the frame, such as on a rear surface of frame.

A variation of the recline mechanism contemplated by the invention is to employ an arm having a grip along the arm itself, such as a bent location along the arm, to serve as the recline actuator. The arm of this variation extends between the mounts 110 and is positioned relative to the seat back frame 42 so that the caregiver can squeeze directly on the arm, at the grip, to release the recline locks 120. This variation eliminates the need for an actuator mount 132 or grip 134. Like grip 134, the arm grip is remote from the recline locks 120. The arm can be in the form of a wire or a cable.

The recline lock 120 is designed as a weight-bearing lock. That is, the recline lock 120 bears the weight of the seat back frame 42 and the child seated in the swing seat. The contact between the detents 122 and the plunger 124, as shown in FIG. 6, allows the recline lock 120 to function as a weight-bearing lock. The detents 122 have a first surface 150 against which a shoulder 152 on the tip of the plunger 124 can be positioned. The contact between the first surface 150 and the shoulder 152 provides weight-bearing capability to the recline lock 120.

Another feature of the recline lock 120 is that the detents 122 can be configured so that the recline actuator 130 need only be actuated to recline the swing seat to a more reclined position and need not be actuated to re-position the swing seat in a less reclined, more upright position. As seen in FIG. 6, the detents can have a ramped surface 154 opposite the first surface 150, and the plunger tip can have a curved surface 156 opposite the shoulder 152. The curved plunger surface 156 can ride along and up the ramped detent surfaces 154 as the seat back frame is moved from a more reclined to a less reclined position. Thus, the caregiver can simply grasp the seat back frame 42 and pivot it to a less reclined position without actuating the recline actuator 130.

Figure 8A:
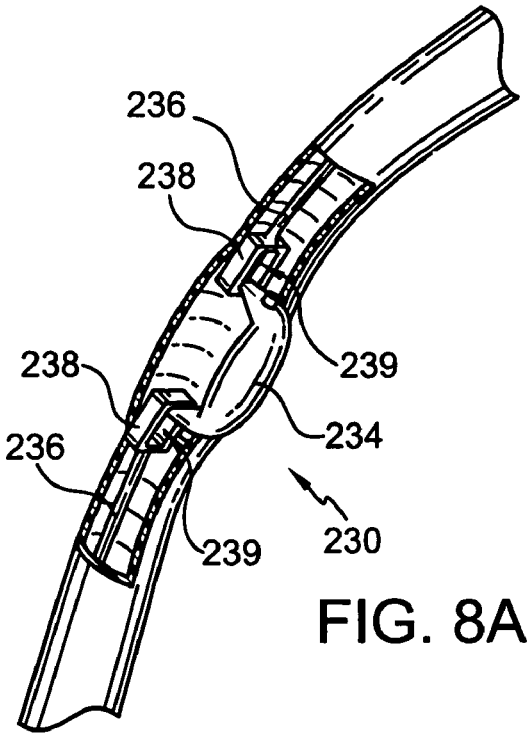
FIG. 8A is a break-away perspective view of an alternative recline actuator.
Figure 8B:
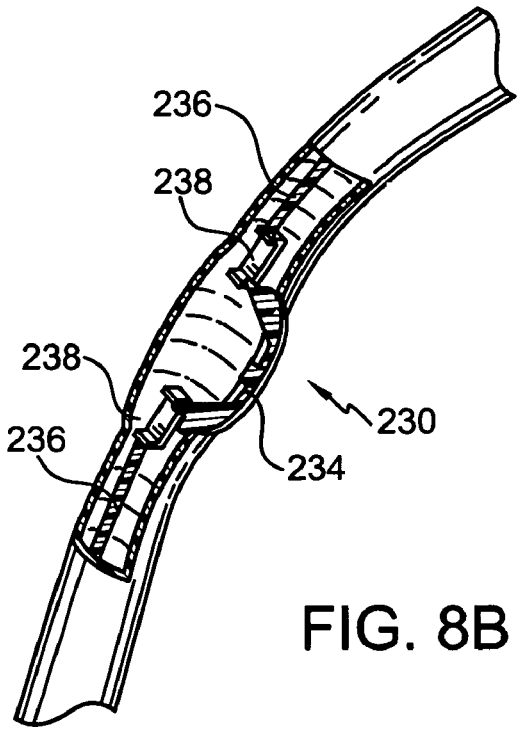
FIG. 8B is a break-away perspective view, in partial cross section, of the of the recline actuator of FIG. 8A in the un-actuated position.
Figure 8C:
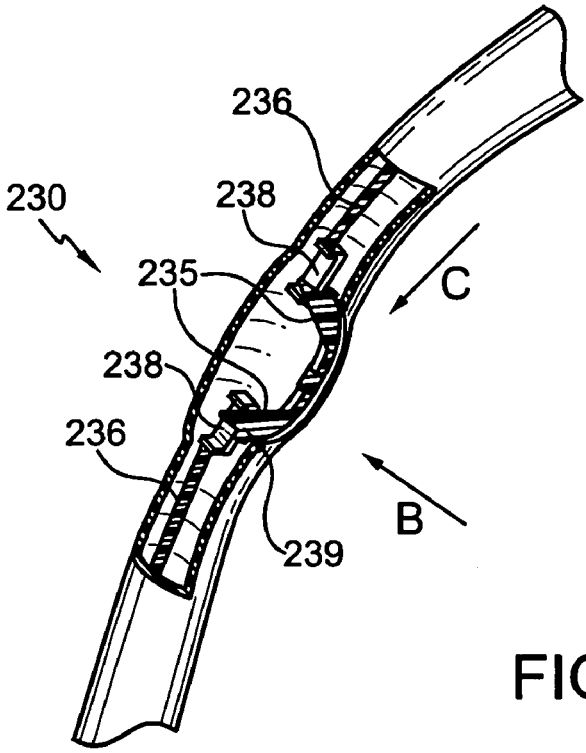
FIG. 8C is a break-away perspective view, in partial cross section, of the recline actuator of FIG. 8A in the actuated position.

FIGS. 8A–8C illustrate an alternative recline actuator 230. This recline actuator 230 is predominantly contained inside the seat back frame 42. The recline actuator 230 includes a push-button grip 234 that projects through the seat back frame 42 and two arms 236 that extend between the push-button grip 234 and the recline locks 120 inside the seat back frame 42. The end of each arm 236 proximate the push-button grip 234 has a connector 238, and the end distal from the push-button grip 234 is coupled to a plunger 124 of a respective recline lock 120 in a manner similar to the embodiment of FIGS. 1–7. A sloped surface 235 of the push-button grip 234 is received within a slot 239 of each connector 238. As a result, when the push-button grip 234 is pushed or squeezed toward the seat back frame 42, in the direction of arrow B in FIG. 8C, the connectors 238 ride along the sloped surfaces 235 of the push-button grip 234 and move inward relative to the push-button grip 234 in the direction of arrow C. As the connectors 238 move inward, the connectors 238 pull the arms 236, which in turn unlock the plungers 134 of the recline locks 120 coupled to the arms 236. To return the plungers 134 to a locked position, the caregiver simply releases the push-button grip 234. The springs associated with the recline locks 120 force the plungers 124 of the recline locks 120 back to their locked position, which in turn pulls the arms 236 toward the recline locks and away from the push-button grip 234. As the arms 236 are pulled away from the push-button grip 234, the connectors 238 return to the un-actuated position shown in FIGS. 8A and 8B.

Figure 9A:
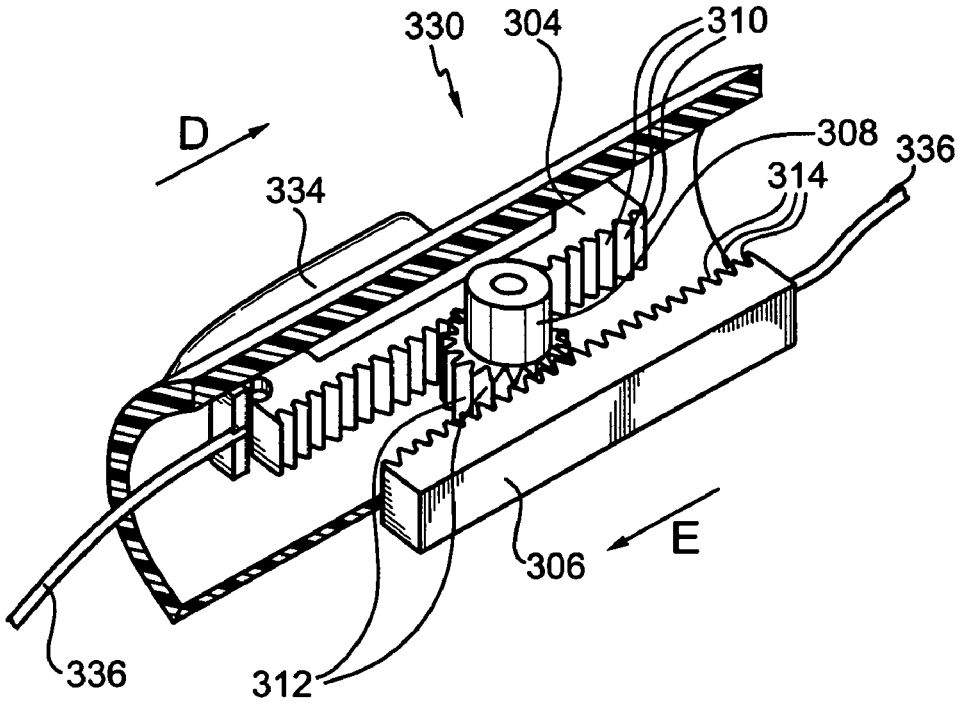
FIG. 9A is a break-away perspective view of another alternative recline actuator.
Figure 9B:
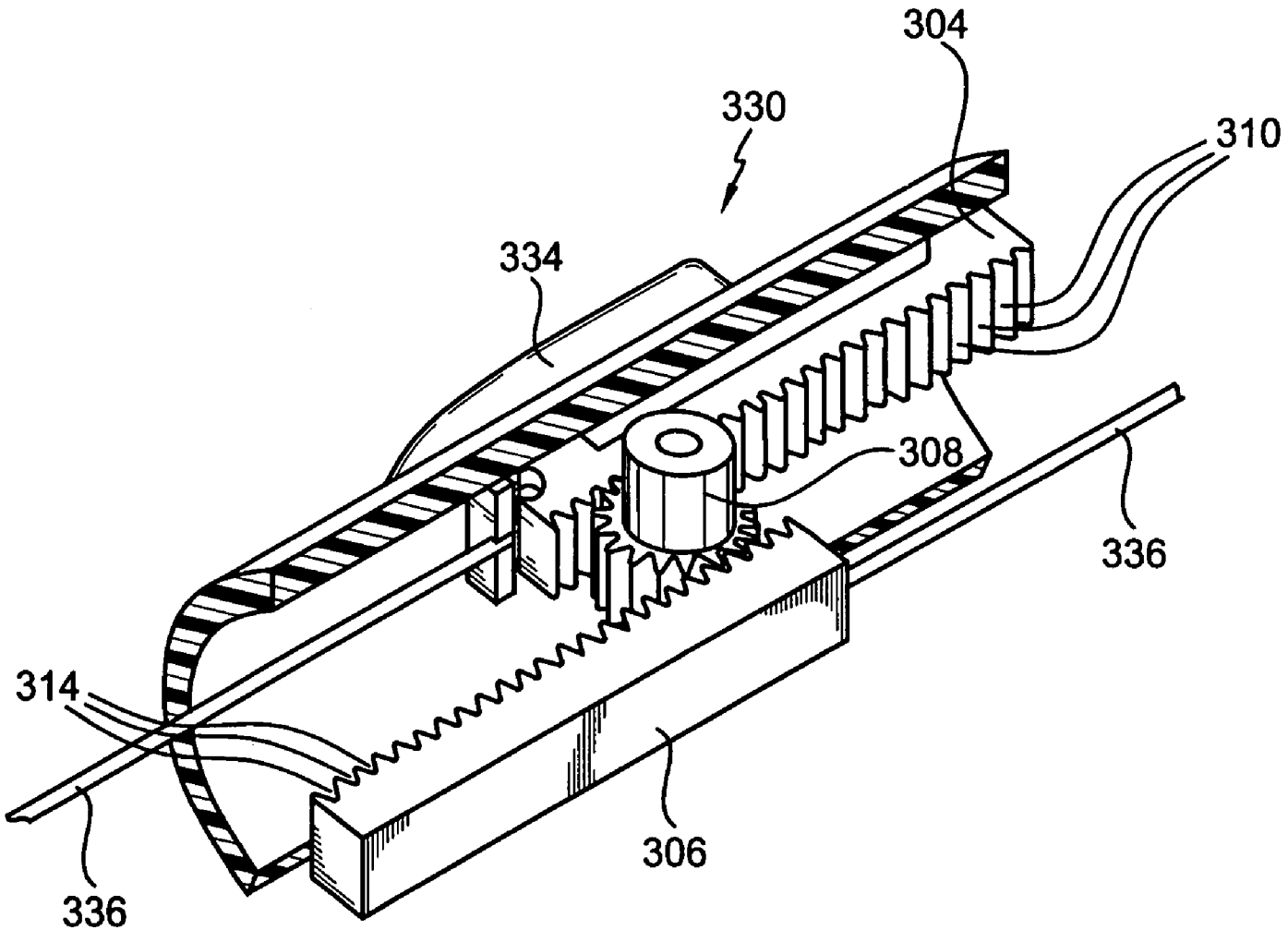
FIG. 9B is a break-away perspective view of the recline actuator of FIG. 9A.

Another recline actuator 330 is shown in FIGS. 9A and 9B. FIG. 9A shows the recline actuator 330 in its un-actuated position, and FIG. 9B shows the recline actuator 330 in its actuated position. The recline actuator 330 includes first and second racks 304, 306, a slide grip 334 fixedly connected to the first rack 304, a pinion 308 (the axis of rotation R of which is fixed), and arms 336 coupled to the recline locks 120. The first rack 304 is connected to an arm 336 leading to one of the recline locks 120, and the second rack 306 is connected to an arm 336 leading to the other of the recline locks 120.

The first rack 304 includes a plurality of recesses 310 that are sized to receive teeth 312 that extend around the pinion 308. Similar to the first rack 304, the second rack 306 also includes a plurality of recesses 314 sized to receive teeth 312 of the pinion 308. To actuate the recline actuator 330, the slide grip 334 can be pushed in a direction parallel to the seat back frame (not shown) as indicated by arrow D. When the slide grip 334 is pushed, the first rack 304 and its arm 336 also move in the direction of arrow D. When the first rack 304 moves in the direction of arrow D, the recesses 310, which are engaged with the teeth 312 of the pinion 308, cause the pinion 308 to rotate about its axis R. Rotation of the pinion 308 drives the teeth 312 into the recesses 314 of the second rack 306, causing the second rack 306 and its arm 336 to move in the direction of arrow E. As a result, both arms 336 are pulled toward the recline actuator 330, as shown in FIG. 9B.

To return the recline actuator 330 to the un-actuated position of FIG. 9A, the caregiver can release the slide grip 334, and the springs of the recline locks 120 force the plungers 124 of the recline locks 120 back to their locked position, which in turn pulls the arms 336 toward the recline locks 120. As the arms 336 are pulled toward the recline locks 120, the first and second racks 304, 306 rotate about the pinion 308 to return to the un-actuated position shown in FIG. 9A.

Other recline actuators are contemplated. For example, instead of the finger grip 134, the push-button grip 234, or the slide grip 334, a twisting or rotating grip could be used. The moving members 114 of the embodiments shown in FIGS. 3A and 3B of U.S. Pat. No. 6,068,284, issued May 30, 2000, which is incorporated herein by reference in its entirety, are two examples of twisting or rotating grips that could be used in a one-hand recline mechanism according to the present invention. The twisting or rotating grips also can include a lever mounted to the moving members that allows for translational (lever) and rotating (moving members) action instead of a pure rotation (moving members) action. Other embodiments may include squeezing action, rotating action, pinching action, pulling action, turning action, or any combination of those actions. A feature common to the various contemplated recline actuators is that they require only one hand to release the recline locks and to control the seat back as the seat back is reclined.

In addition, other recline locks are contemplated. For example, instead of recline locks 120, a gear arrangement with teeth that mesh and un-mesh could be used as the recline locks of the present invention. One suitable gear arrangement is described and illustrated in U.S. patent application Ser. No. 10/999,148, filed Nov. 30, 2004, which is incorporated herein by reference in its entirety. As another example, a VALCO button arrangement could be used as the recline locks of the present invention. The button could be disposed in each mount 110 to move in a direction parallel to the axis of rotation of the seat back. This button could be actuated by the recline actuator 130 in a manner similar to the manner in which the gear arrangement of U.S. patent application Ser. No. 10/999,148 is actuated.

As another alternative, where the seat bottom frame 44 is made of plastic, the mounts 110 and the seat bottom frame 44 can be molded as a single piece of material.

Figure 10:
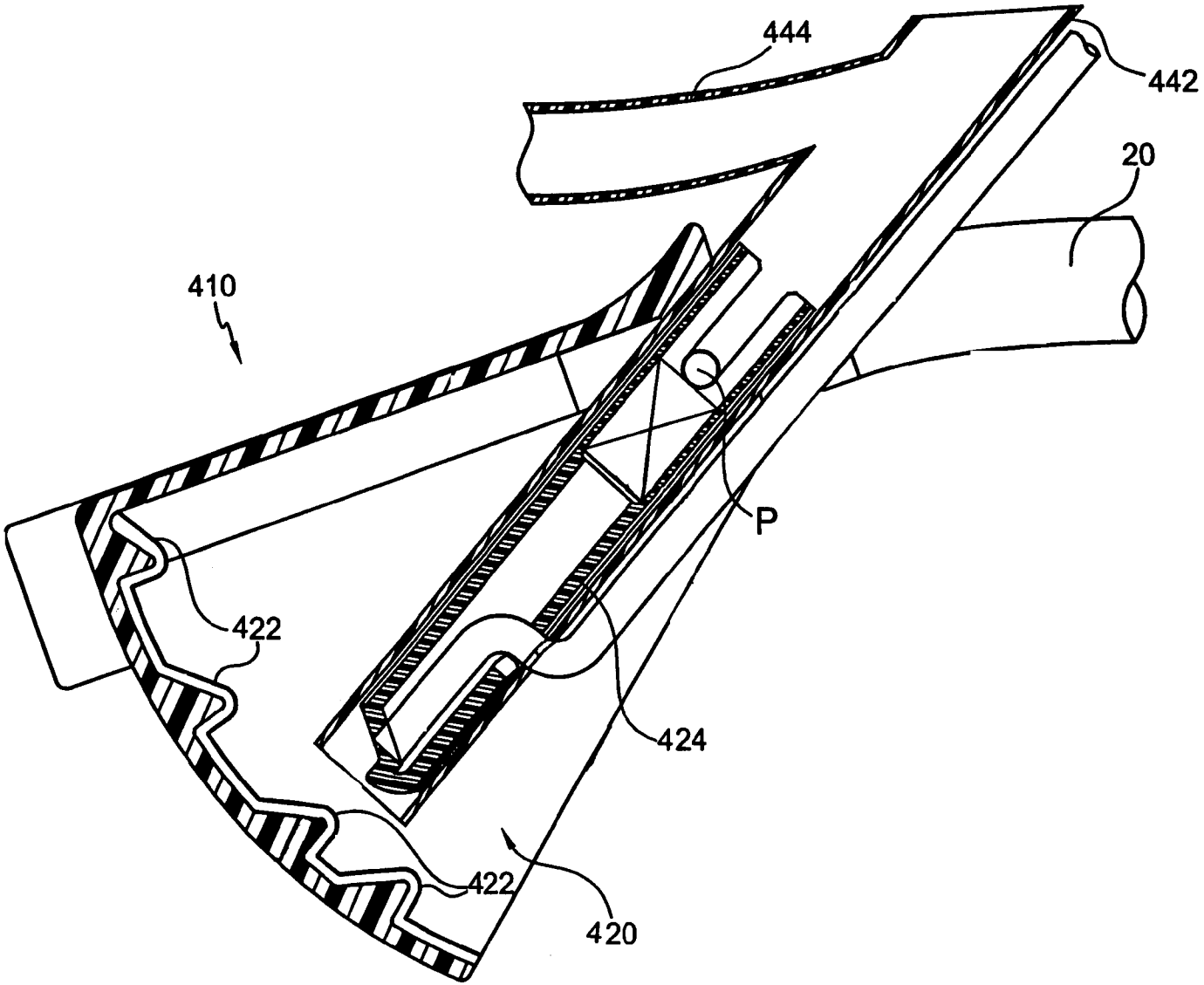
FIG. 10 is a side view, in partial cross section, of a recline lock in the unlocked position in an alternative embodiment of the invention.

FIG. 10 illustrates another embodiment of the invention. In this embodiment, the seat back frame 442 and the seat bottom frame 444 are formed together as a unitary body. The seat back frame 442 and the seat bottom frame 444, for example, can be molded from a single piece of plastic material. The seat, including both the seat back frame 442 and the seat bottom frame 444, can be supported on the swing frame by first and second hanger arms, one hanger arm 20 being shown in FIG. 10. In this regard, mounts 410 on either side of the seat can couple the seat to the first and second hanger arms. The components of the recline lock 420 can be generally the same as those of recline lock 120 of FIG. 7; recline lock 420 can include detents 422 formed in the mount 410 and a plunger 424. In addition, any of the above-described recline actuators can be employed in this embodiment. Unlike the embodiment of FIG. 1, in which only the seat back frame 42 can move about pivot pin P, however, both the seat back frame 442 and the seat bottom frame 444, that is, the entire seat, can be moved to a new recline position about pivot pin P.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A swing comprising:

a swing frame; and a seat supported by the swing frame, the seat including a seat bottom frame, a seat back frame movably coupled to the seat bottom frame, and a recline mechanism to recline the seat back frame relative to the seat bottom frame, the recline mechanism including first and second mounts on opposite sides of the seat to movably mount the seat back frame to the seat bottom frame, at least one recline lock associated with at least one of the first and second mounts and configured to lock the seat back frame in at least two recline positions relative to the seat bottom frame, the at least one recline lock movable between a locked position to set the recline position of the seat back frame relative to the seat bottom frame and an unlocked position to allow adjustment of the recline position of the seat back frame relative to the seat bottom frame, and a recline actuator having a grip intermediate the first and second mounts and movable between an un-actuated position and an actuated position, the recline actuator being coupled to the at least one recline lock such that movement of the recline actuator from the un-actuated position to the actuated position moves the at least one recline lock from the locked position to the unlocked position, wherein the recline actuator grip slides in a direction parallel to the seat back frame.

2. The swing according to claim 1, further comprising first and second hanger arms coupled rotatably to the swing frame and coupled to the first and second mounts, respectively.

3. The swing according to claim 1, wherein the recline actuator comprises an arm extending between the first and second mounts and movable relative to the seat back frame, and wherein the grip is provided on the arm.

4. The swing according to claim 3, wherein the arm is in the form of a wire or a cable.

5. The swing according to claim 1, wherein the recline actuator includes an actuator mount provided on the seat back frame, the grip movably mounted to the actuator mount, and an arm extending between the grip and the at least one recline lock.

6. The swing according to claim 1, wherein the at least one recline lock comprises first and second recline locks associated with the first and second mounts, respectively, and wherein the recline actuator is coupled to the first and second recline locks such that movement of the recline actuator from the un-actuated position to the actuated position moves the first and second recline locks from their locked position to their unlocked position.

7. The swing according to claim 6, wherein the recline actuator includes an arm extending between the first and second recline locks, and the grip is provided on the arm, the arm being movable relative to the seat back frame.

8. The swing according to claim 7, wherein the arm is in the form of a wire or a cable.

9. The swing according to claim 7, wherein the seat back frame comprises a tubular member, and the arm has substantially the same contour as the seat back frame.

10. The swing according to claim 1, wherein the seat back frame is tubular, and first and second ends of the seat back frame are movably coupled to the first and second mounts.

11. The swing according to claim 1, wherein the at least one recline lock comprises a series of detents formed in the one mount, and a plunger connected to the recline actuator to move between the unlocked position, in which the plunger is spaced from the detents, and the locked position, in which the plunger contacts a selected one of the detents, wherein the detents correspond to the recline positions of the seat back frame.

12. The swing according to claim 11, wherein the plunger is biased to its locked position.

13. The swing according to claim 11, wherein the seat back frame is tubular, and the plunger is disposed inside the tubular seat back frame.

14. The swing according to claim 11, wherein the plunger is positioned adjacent to and exteriorly of the seat back frame.

15. The swing of claim 1, wherein the grip of the recline actuator is arranged relative to the seat back frame such that the recline actuator can be actuated and the seat back frame can be supported during recline with only one hand and selectively from either one of the front and the back of the seat back frame.

16. The swing according to claim 1, wherein the grip is located at a top of the seat back frame.

17. The swing according to claim 1, wherein the seat back frame is tubular, the seat bottom frame is tubular, and the seat includes a fabric cover suspended from the tubular seat back frame and the tubular seat bottom frame.

18. A swing comprising:

a swing frame;

first and second hanger arms moveably mounted to the swing frame; and a seat supported by the swing frame, the seat including a seat bottom frame, a seat back frame movably coupled to the seat bottom frame, and a recline mechanism to recline the seat back frame relative to the seat bottom frame the recline mechanism including first and second mounts on opposite sides of the seat to movably mount the seat back frame to the seat bottom frame, at least one recline lock associated with at least one of the first and second mounts and configured to lock the seat back frame in at least two recline positions relative to the seat bottom frame, the at least one recline lock movable between a locked position to set the recline position of the seat back frame relative to the seat bottom frame and an unlocked position to allow adjustment of the recline position of the seat back frame relative to the seat bottom frame; and a recline actuator having a grip supported by an actuator mount and located intermediate the first and second mounts and movable between an un-actuated position and an actuated position, the recline actuator being coupled to the at least one recline lock such that movement of the recline actuator from the un-actuated position to the actuated position moves the at least one recline lock from the locked position to the unlocked position, wherein the grip slides in a direction normal to the actuator mount when actuated.

19. The swing seat according to claim 18, wherein the recline actuator includes an arm extending between the first and second mounts and movable relative to the seat back frame, and the grip is provided on the arm.

20. The swing seat according to claim 19, wherein the arm is in the form of a wire or a cable.

21. The swing seat according to claim 18, wherein the recline actuator includes an actuator mount provided on the seat back frame, the grip movably mounted to the actuator mount, and an arm extending between the grip and the at least one recline lock.

22. The swing seat according to claim 18, wherein the at least one recline lock comprises a series of detents formed in the one mount, and a plunger connected to the recline actuator to move between the unlocked position, in which the plunger is spaced from the detents, and the locked position, in which the plunger contacts a selected one of the detents, wherein the detents correspond to the recline positions of the seat back frame.

23. The swing seat according to claim 22, wherein the plunger is biased to its locked position.

24. The swing seat according to claim 22, wherein the seat back frame is tubular, and the plunger is disposed inside the tubular seat back frame.

25. The swing seat according to claim 22, wherein the plunger is positioned adjacent to and exteriorly of the seat back frame.

26. The swing seat of claim 18, wherein the grip of the recline actuator is arranged relative to the seat back frame such that the recline actuator can be actuated and the seat back frame can be supported during recline with only one hand and can be selectively actuated from either one of the front and the back of the seat back frame.

27. The swing seat according to claim 18, wherein the grip is located at a top of the seat back frame.

28. The swing seat according to claim 18, wherein the seat back frame is tubular, the seat bottom frame is tubular, and the seat includes a fabric cover suspended from the tubular seat back frame and the tubular seat bottom frame.

29. A swing comprising:

a swing frame; and a seat supported by the swing frame, the seat including a seat bottom, a seat back movably coupled to the seat bottom, and a recline mechanism to recline the seat back relative to the seat bottom, the recline mechanism including first and second mounts on opposite sides of the seat to movably mount the seat back to the seat bottom, first and second recline locks associated with the first and second mounts, respectively, and configured to lock the seat back in at least two recline positions relative to the seat bottom, each of the first and second recline locks movable between a locked position to set the recline position of the seat back relative to the seat bottom and an unlocked position to allow adjustment of the recline position of the seat back relative to the seat bottom, and a recline actuator having a grip remote from the first and second recline locks, the recline actuator being coupled to the first and second recline locks such that movement of the recline actuator from the un-actuated position to the actuated position moves the first and second recline locks from the locked position to the unlocked position, wherein the grip is located near the top of the seat back in a cavity through the seat back such that the user can selectively access the grip from either one of the front and the back of the seat back.

30. The swing seat according to claim 29, further comprising first and second hanger arms rotatably coupled to the swing frame and coupled to the first and second mounts, respectively.

31. The swing seat according to claim 29, wherein the recline actuator includes an arm extending between the first and second recline locks, and the grip is coupled to the arm.

32. The swing seat according to claim 31, wherein the arm is in the form of a wire or a cable.

33. The swing seat according to claim 31, wherein the seat back includes a tubular member, and the arm has substantially the same contour as the tubular member.

34. The swing seat according to claim 29, wherein the recline actuator includes an actuator mount provided on the seat back, the grip movably mounted to the actuator mount, and first and second arms extending from the grip to the first and second recline locks, respectively.

35. The swing seat according to claim 34, wherein the first and second arms form a single continuous arm.

36. The swing seat according to claim 34, wherein the grip slides in a direction parallel to the seat back when actuated.

37. The swing seat according to claim 29, wherein each of the first and second recline locks comprises a series of detents formed in the respective first and second mounts, and a plunger connected to the recline actuator to move between the unlocked position, in which the plunger is spaced from the detents, and the locked position, in which the plunger contacts a selected one of the detents, wherein the detents correspond to the recline position of the seat back.

38. The swing seat according to claim 37, wherein the seat back includes a tubular frame, and first and second ends of the tubular frame are movably coupled to the first and second mounts.

39. The swing seat according to claim 37, wherein the plunger of each of the first and second recline locks is disposed inside the respective one of the first and second ends of the tubular frame.

40. The swing seat according to claim 29, wherein the seat back is a tubular frame, the seat bottom is a tubular frame, and the seat includes a fabric cover suspended from the tubular seat back frame and the tubular seat bottom frame, and wherein the grip is accessible through an opening in the fabric cover.

41. A swing comprising:

a swing frame;

first and second hanger arms moveably mounted to the swing frame; and a seat supported by the swing frame, the seat including a seat bottom frame, a seat back frame movably coupled to the seat bottom frame, and a recline mechanism to recline the seat back frame relative to the seat bottom frame, the recline mechanism including first and second mounts on the seat to movably mount the seat back frame to the seat bottom frame, at least one reline lock associated with at least one of the first and second mounts and configured to lock the seat back frame in at least two recline positions relative to the seat bottom frame, the at least one recline lock movable between a locked position to set the recline position of the seat back frame relative to the seat bottom frame and an unlocked position to allow adjustment of the recline position of the seat back frame relative to the seat bottom frame, and a recline actuator arranged between the first and second mounts whereby the recline actuator includes a grip that is slidably movable between an un-actuated position and an actuated position, such that the grip of the recline actuator can be selectively actuated from either one of the front and the back of the seat back from a location remote from the at least one recline lock, and movement of the recline actuator from the un-actuated position to the actuated position moves the at least one recline lock from the locked position to the unlocked position.

42. A swing comprising:

a swing frame;

first and second hanger arms movably mounted to the swing frame;

a seat supported by the first and second hanger arms on the swing frame; and a recline mechanism to recline the seat relative to the first and second hanger arms, the recline mechanism including first and second recline locks, a grip, and a single continuous stiff wire connecting the first and second recline locks, wherein the grip is coupled to the stiff wire and sliding movement of the grip toward a top of the seat moves the stiff wire with respect to the seat back frame and disengages the recline locks.

43. The swing according to claim 42, wherein the grip of the recline mechanism is selectively accessible through a cavity in the seat back from either one of a front side and a back side of the seat.

44. A swing comprising:

a swing frame;

first and second hanger arms moveably mounted to the swing frame; and a seat supported by the swing frame, the seat including a seat bottom, a seat back movably coupled to the seat bottom, and a recline mechanism to recline the seat back relative to the seat bottom, the recline mechanism including first and second mounts on the seat to movably mount the seat back to the seat bottom, first and second recline locks associated with the first and second mounts and configured to lock the seat back in at least two recline positions relative to the seat bottom, the first and second recline locks movable between a locked position to set the recline position of the seat back and an unlocked position to allow adjustment of the recline position of the seat back relative to the seat bottom, and a recline actuator including a single continuous stiff wire connected to the first and second recline locks such that the recline actuator can be actuated from a location remote from the first and second recline locks, wherein movement of the recline actuator moves the stiff wire which in turn moves the first and second recline locks between their respective locked and unlocked positions.

* * * * *